US006797928B2

(12) United States Patent
Giberson et al.

(10) Patent No.: US 6,797,928 B2
(45) Date of Patent: Sep. 28, 2004

(54) METHOD AND APPARATUS FOR THE RAPID DECALCIFICATION AND FIXATION OF MINERALIZED TISSUES

(75) Inventors: Richard T. Giberson, Chico, CA (US); Paul A. Hansen, Anderson, CA (US); Mark J. Armogida, Redding, CA (US)

(73) Assignee: Ted Pella, Inc., Redding, CA (US)

( * ) Notice: Subject to any disclaimer, the term of this patent is extended or adjusted under 35 U.S.C. 154(b) by 60 days.

(21) Appl. No.: 10/128,012

(22) Filed: Apr. 23, 2002

(65) Prior Publication Data

US 2003/0197008 A1 Oct. 23, 2003

(51) Int. Cl.[7] ..... H05B 6/80
(52) U.S. Cl. ..... 219/679; 219/687; 219/762
(58) Field of Search ..... 219/745, 694, 219/732, 679, 687, 762; 435/4, 40.5, 40.52, 173.1, 173.4; 606/81; 422/21

(56) References Cited

U.S. PATENT DOCUMENTS

| | | | | |
|---|---|---|---|---|
| 5,068,086 | A * | 11/1991 | Sklenak et al. | 435/40.5 |
| 6,207,408 | B1 * | 3/2001 | Essenfeld et al. | 435/40.5 |
| 6,329,645 | B2 | 12/2001 | Giberson et al. | |
| 6,586,713 | B2 * | 7/2003 | Essenfeld et al. | 219/679 |
| 2002/0177183 | A1 * | 11/2002 | Gilberson et al. | 435/40.5 |

OTHER PUBLICATIONS

New Tissue Fixation Method for Gytochemistry Using Microwave Irradiation. Authors: Vince Mizuhira, Mitsuru Notoya and Hiroshi Hasegawa. Acta Histochemica et Cytochemica, vol. 23, No. 4, 1990.

Microwave applications on small insect brain tissue irradiated in a water–perfused cooling–jacket for temperature control. Author: Hans M. Smid. Journal of Neuroscience Methods; Department of Entomology, Wageningen Agricultural University, Binnenhaven 7, 6709 PD Wageningen, The Netherlands. Accepted Aug. 18, 1994.

U.S. patent application Ser. No. 60/292,817, Giberson et al., filed May 22, 2001.

U.S. patent application Ser. No. 60/309,654, Giberson, filed Aug. 1, 2001.

Decalcification acceleree par les micro–ondes. Authors: A.J. Balaton and P. Loget; Ann. Pathol. 1989. 9 No 2, pp. 140–141.

Decalcification of teeth in a microwave oven. Authors: N. Vongsavan, B. Matthews and G.K. Harrison, Histochemical Journal 22, pp. 377–380, (1990).

(List continued on next page.)

*Primary Examiner*—Quang T Van
(74) *Attorney, Agent, or Firm*—Rick Martin; Patent Law Offices of Rick Martin, P.C.

(57) ABSTRACT

A method and apparatus for rapid fixation and decalcification of calcified tissues using a MW oven with adjustable variable continuous power output, a specialized tissue handling system and an external temperature control device to maintain reagent temperature control external to the MW environment. Tissues are placed in cassettes, which are then placed in a tissue handling system. The tissue handling system also provides a specialized external container, which allows for the recirculation and cooling of reagents external to the MW cavity. The external device is a recirculation device having both heating and cooling capacities for a range of different processing reagents.

5 Claims, 7 Drawing Sheets

OTHER PUBLICATIONS

Microwave Over for Improved Tissue Fixation and Decalcification, Authors: F. Roncaroli, B. Mussa G. Bussolati. Pathologica, 83, pp. 307–310, 1991.

High–resolution Immunocytochemistry of Noncollagenous Matrix Proteins in Rat Mandibles Processed with Microwave Irradiation. Authors: Victor E. Arana–Chavez and Antonio Nanci. The Journal of Histochemistry & Cytochemistry, vol. 49(9), pp. 1099–1109, 2001.

Undecalcified Temporal Bone Morphology: A Methodology Useful for Gross to Fine Observation and Three–Dimensional Reconstruction. Authors: Tatsuya Fujiyoshi, Goro Mogi, Tetsuo Watanable and Futoshi Matsushita. Acta Otolaryngol (Stockh) 1992; Sjuppl. 4983: pp 7–13.

Microwave Assisted Decalcification with Recirculation of Temperature Controlled Solutions. Authors: S.P. Tinling, R. Kullar, R.T. Giberson, 2 pages.

The Microwave Oven in Temporal Bone Research. Authors: Sten Hellstrom and Magnus Nilsson. Acta Otolaryngol (Stockh) 1992; Suppl. 493: pp. 15–18.

Microwave histoprocessing of bone marrow trephine biopsies. Authors: I. Louw, D.P. DeBeer and M.J. DuPlessis. Histochemical Journal 26, pp. 487–494 (1994).

Rapid decalcification of temporal bones with preservation of ultrastucture. Authors: Victoria J. Madden and Miriam M. Henson. Hearing Research 111 (1997) pp. 76–84.

Rapid Decalcification Using Microwaves for in Situ Hybridization in Skeletal Tissues. Authors: Motoharu Kaneko, Tetsuya Tomita, Takanobu Nakase, Eiji Takeuchik, Motoki Iwasaki, Kazuomi Sugamoto, Kazuo Yoneobu and Takahiro Ochi,. Department of Orthopaedic Surgery, Osaka University Medical School, 2–2, Yamadaoka, Suita, 565–0871, Japan, Sibmitted Apr. 8, 1998; revised Sep. 7, 1998; Accepted Sep. 9, 1998. pp. 49–54.

Immunohistochemistry and microwave decalcification of human temporal bones. Authors: Elizabeth M. Keithley, Tim Truong, Brandy Chandronait, Peter B. Billings, Hearing Research 148 (2000), pp. 192–196.

Using the Microwave Oven for Decalcification of Human Temporal Bones. Authors: Elizabeth M. Keithley, Ph.D., Tim Truong, B.S.; Brandy Chandronait and Peter B. Billings, Ph.D. National Temporal Bone Registry, The Registry Newsletter, Spring/Summer 2001, vol. 9, No. 1.

Microwave–Accelerated Decalcification.—Useful Methods for Research and Clinical Laboratories. Author: Victoria J. Madden. Microwave Techniques and Protocols, pp. 100–122.

Intraoperative Microwave Processing of Bone Margins During Resection of Head and Neck Cancer. Authors: Edward C. Weisberg, MD; Matthew Hilburn, MD; Bradley Johnson, HT (ASCP); Charly Nguyen, MD,. ( Reprinted) Archotolaryngol Head Neck Surg./vol. 127, Jul. 2001.

Microwave Decalcification of Human Temporal Bones. Authors: Calhoun D. Cunningham III, MD; Bradley A. Schulte, Ph.D.; Lynne M. Blanchi, Ph.D.; Peter C. Weber, MD; Barbara N. Schmiedt, MT, HT (ASCP). Laryngoscope 111: Feb. 2001, pp. 278–282.

URL reference: Procedure 3.1 Accumate (tm) RDO Rapid Bone Decalcification Procedure. No author. http://www.ebsciences.com/staining/bn_decal.htm pp. 1–2.

URL reference: Working Procedures in Microwave Histology. Microwave Simulated Decalcification, p. 4 and Microwave Stimulated Fixation: Advantages and Disadvantages, p. 5. Author: Vincent R. Klump, Jr., HT (ASCP), Histology Services, East Haven, CT.

BONE. Author: R.J. Moore. Woods and Ellis 2000, pp 1–16.

Decalcification of Bone: Literature Review and Practical Study of Various Decalcifying Agents, Methods, and Their Effects on Bone Histology. Authors; Gayle Callis and Diane Sterchi. The Journal of Histotechnology/vol. 21, No. 1., Mar. 1998, pp. 49–58.

A Rapid Method For Routine Processing of Iliac Crest Bone Marrow Trephine Biopsies. Tissue Talk. May Ed. 1994, pp. 3–4 Author: R.D. Rainbow.

* cited by examiner

METHOD AND APPARATUS FOR THE RAPID DECALCIFICATION AND FIXATION OF MINERALIZED TISSUES

FIELD OF THE INVENTION

The present invention relates to a methodology and apparatus for rapid tissue decalcification and fixation employing a microwave ("MW") oven with variable adjustable low wattage, a specialized tissue handling device and external reagent temperature control to gain the maximum benefit of MW irradiation without the heating problems associated with other MW methods.

BACKGROUND OF THE INVENTION

Clinical and research analysis of tissue samples is an ongoing science. Bone tissue samples require that the calcium be removed prior to sectioning of tissue for microscopic analysis. In prior art it is known that MW irradiation of tissue samples will accelerate the process of decalcification and fixation when compared to routinely accepted bench tissue specimen processing methods. Prior art methods immerse a tissue sample in a reagent in a container placed in a MW oven. Prior art reagents include fixatives, acids, and chelators, as well as mixtures of those reagents. Prior art has demonstrated that use of corrosive acids must be carefully monitored and controlled to avoid tissue specimen destruction. Known MW irradiation methods require reagent changes for each one of multiple runs of the MW process. In prior art, elevated temperatures are commonly used for each cycle. Using prior art, MW-assisted/temperature-based processing methods have required these multiple reagent changes and a temperature control between 37° C. and 45° C. to maintain best sample quality, although prior art also demonstrates use of much higher temperatures. It has been demonstrated in prior art that temperatures above 45° C. have accelerated the process further, but also has demonstrated tissue damage at those temperatures. Temperature control, by whatever means, is done by turning the magnetron on and off at an uncontrolled rate to maintain a preset temperature maximum. Using this known approach, the amount of MW energy applied to the sample will vary from run to run. These MW assisted methods, by necessity, rely on a temperature maximum or restriction that is above the ambient temperature to insure that the magnetron would activate and produce microwaves.

Time savings in processing samples will have a direct effect on surgical and clinical pathology, drug development and basic research in a wide range of fields from veterinary to human medicine and clinical pathology as well as research in medicine and the pharmaceutical industry. Reduction in times when using MW processing over established room temperature methods have been reported to be from 10 to 100 fold.

What is needed is a decalcification and fixation methodology that: 1) Utilizes a range of wattage between 50 w and 750 w MW processing; 2) uses a reagent circulation system as opposed to a static immersion system; 3) uses non-corrosive reagents; and 4) creates time saving as addressed above while producing quality and consistent results. The present invention addresses each of these needs.

SUMMARY OF THE INVENTION

The main aspect of the present invention is to provide an improved method for decalcification and fixation of mineralized samples utilizing apparatus consisting of off-the-shelf components that control all processing variables.

Another aspect of the present invention is to provide standardization of the described process across the clinical and research community.

Another aspect of the present invention is to provide a MW-assisted method not relying on MW heating as a component of the process but consisting of a continuous MW energy during the entire process.

Another aspect of the present invention is to provide for adjustment of the wattage output of the MW oven to optimize tissue decalcification and fixation turn-around time.

Another aspect of the present invention is to provide a system that, for the first time, controls all processing parameters in the decalcification and fixation of tissue. Such parameters include the amount of MW irradiation, wattage, temperature, time, etc.

Another aspect of the present invention is to provide for the control of all processing variables associated with previously published MW decalcification and fixation methods and test their validity.

Another aspect of the present invention is to increase productivity by reducing tissue sample turn around time in all settings while producing excellent processing results.

Another aspect of the present invention is to provide for a processing method utilizing commonly accepted reagents.

Another aspect of the present invention is to gain a rapid turn around time formerly dependent on the use of corrosive acids by substituting EDTA (ethylenediamine tetraacetic acid) and formalin in a MW environment.

Another aspect of the present invention is to provide an identifiable tissue specimen cassette and a cassette holder (tissue handling device) for holding tissue specimen cassettes in place during processing.

Other aspects of this invention will appear from the following description and appended claims, reference being made to the accompanying drawings forming a part of this specification wherein like reference characters designate corresponding parts in the several views.

The present invention provides rapid decalcification and fixation of mineralized tissues. The process utilizes a MW oven, which has adjustable wattage output to maintain operation within a narrow set of parameters. Tissue handling and identification with this system can be accomplished by standardized methods combined with a specialized containment device that is both solvent resistant and MW transparent. A MW oven operating at 2.45 GHz was used in the preferred embodiment of the present invention.

Further aspects of the system of the present invention are the variable wattage processing parameters that can be employed, for the first time, in the decalcification and fixation of tissue samples.

The present invention can increase productivity in all settings described and is anticipated to produce excellent processing results when ethylenediamine tetraacetic acid (EDTA) and 10% neutral buffered formalin are combined. EDTA is known to preserve tissue ultrastructure when the decalcification process is accelerated in the MW. Other reagents can be used, some of which are described below.

Further aspects of the present invention speak directly to the problems associated with other MW methods. The invention provides for the control of all processing variables associated with previously published MW decalcification methods. The present invention also suggests a non-thermal MW effect as a processing variable in simultaneous decalcification and fixation procedures.

DETAILED DESCRIPTION OF INVENTION

The present invention utilizes a methodology for decalcification and fixation using off-the-shelf apparatus that consists (but not limited to) the following hardware apparatus and processing methodology:

A. Use of MW oven with a continuous power output range from 50 w to 750 w. Magnetron power settings are adjustable within a narrow range (typically +/−25 w) and maintain internal temperature control to about +/−0.5° C.

B. Use of a wide range of reagents such as EDTA and formalin (or others as acceptable).

C. Use of off-the-shelf hardware processing apparatus such as (but not limited to):

a. MW oven (see above) with adjustments for continuous power outputs of approximately 50 w to 750 w, time, temperature, monitoring probe, and input/output ports for external reagent circulation channels, and processing time control settings between about 1 sec and 100 hours.

b. An external recirculation device for continuous reagent recirculation, mixing, agitation, and temperature control which has both heat and cooling capabilities for the circulating reagent in order to maintain constant temperature, within narrow limits, of the reagent being circulated through a tissue handling device. The external recirculation device has an input and an output hose with a duplex pump to recirculate the reagent as it is being heated or cooled.

c. An internal MW oven processing bath into which is placed a tissue handling device.

d. A removable tissue handling device, which contains tissue(s) enclosed in histology tissue cassettes for decalcification and fixation.

e. A lid for the tissue handling device, which has one hole for a temperature probe.

f. An internal MW oven over-fill safety tray to capture any reagent spillage.

g. Utilization of anti-siphon and flow control devices to maintain a uniform reagent level within the tissue handling device to insure that tissue samples are continuously under reagent throughout the process.

h. Utilization of tissue histology cassettes capable of holding tissue samples and capable of being inserted into the tissue handling device.

i. Histology cassette tissue specimen holder, which is placed into the tissue handling device to secure and identify individual mineralized tissues.

j. Temperature probe inserted through the lid hole of the tissue handling device and into reagent contained within the tissue handling device. The temperature probe is used for monitoring and recording of the processing reagent temperature and can be used as a secondary reagent temperature control in case of any failure in the temperature control of the recirculation apparatus.

k. Use of materials that are both MW transparent and solvent resistant for the aforementioned trays, lids, handling devices, cassettes, tubing, etc. The materials used can be PTFE, polypropylene, polyethylene, silicone or similar materials.

l. Other components as required.

The above components and reagents, when used with the methodology of the present invention, will insure fixation and decalcification of the tissue samples at temperatures in the range of approximately 5° C. to 45° C. via continuous MW irradiation during the process. The results will show significant time savings exceeding 90% over routine processing methods and will be able (with accumulated tissue processing history) to result in one-step automatic processing of tissue samples for fixation and decalcification.

Typical specifications for a bath circulator are as follows:

A) Refrigeration and Heating System

1. Recirculation Temperature Range: −25° C. to 150° C.
2. Cooling Capacity: 500 watts at 20° C. reagent temp.
3. Temperature Stability: +/−0.01° C.
4. Heater Wattage: 2000 watts B) Pumping System 1. Pump Flow: 15 liters per minute max.
2. Pump Pressure: 0.5 bar (16' head) max.
3. Pump type: Force and suction C) General Specifications 1. Seamless stainless steel reservoir for easy cleaning and excellent reagent compatibility.
2. Reservoir drain for efficient reagent changes.
3. Wetted materials: Stainless steel, or other non-corrosive materials.
4. Reservoir Volume: 7 liters (1.9 gallons)
5. Unit dimensions: Approximately 60 cm×24 cm×45 cm.
6. Certifications: UL, CSA, CE Mark as required.

The non-uniform sample heating attributed to prior MW processes is not relevant with the present invention due to the volume and depth of reagent required within the MW cavity. Prior art has demonstrated that uneven sample heating, due to the presence of hot and cold spots within the MW cavity, can be greatly mitigated through the external recirculation and cooling of a similar reagent volume. Prior art also demonstrates that MW-assisted formalin fixation is a wattage dependent, not temperature dependent, process.

The combination MW-assisted decalcification and fixation will produce faster turnaround times. This outcome will facilitate: 1) diagnostic evaluation of surgical or clinical specimens; 2) faster treatment; 3) more efficient drug development and testing schedules; and 4) less wasted time in basic research for veterinary or human medicine.

The present invention outlines a methodology and apparatus, for the first time, that replaces MW-mediated sample temperature control with an external means based on the recirculation and cooling and/or heating of the processing reagent to maintain a constant temperature within the MW environment. This change makes the standardization of MW assisted processing a reality for the first time through the control of all of the processing variables (duration of MW sample exposure, wattage, temperature, time, sample processing environment). The key variable covered by the present invention is the ability to provide continuous MW energy between 50 w and 750 w for any time period between 1 second and 100 hours.

The present invention is the first to accelerate the fixation and decalcification processes using classical reagents: 10% neutral buffered formalin and EDTA that do not adversely affect sample quality. The use of 10% neutral buffered formalin is the standard fixative used in surgical and clinical pathology. EDTA, buffered or not, has been shown to preserve the structural integrity of tissues when used for decalcification. The aforementioned reagents are basically well known and widely used within clinical and surgical pathology. Other combinations of fixatives are known to work in combination with EDTA in a MW environment (unpublished research). Other decalcification reagents such as formic acid-based reagents, nitric acid-based reagents, hydrochloric acid-based reagents, sulphuric acid-based reagents, acetic acid-based reagents and mixtures of those reagents as well as proprietary reagents (e.g. Decal®, Decal Stat®, Formical-2000®, Immunocal®) and fixatives such as zinc formalin, glutaraldehyde, paraformaldehyde, glyoxal, alcohol, acetone and proprietary reagents (e.g. Prefer, Preserve™) can also be used.

The present invention provides rapid processing including the ability to do an overnight process, without attendance by a technician. Only end point testing for decalcification would require technician intervention. Thus this process improves current tissue sample turnaround times for the processing of calcified tissues while at the same time provides standardization of the process throughout the clinical and research community.

Tissue handling and identification with the system of the present invention can be accomplished by standardized methods combined with a specialized containment device that is both solvent resistant and MW transparent. The specialized containment device, combined with a reagent container inside the MW, insures that the samples will remain covered by the processing reagent continuously throughout the process of decalcification and fixation. Anti-siphon and flow control devices included as part of the system, as well as the container design used inside the MW cavity insure the samples remain covered with the circulating reagent.

Further aspects of the system of the present invention are the low wattage processing parameters that can be employed, for the first time, in the decalcification and fixation of tissue samples. The continuous movement of the processing reagent around the samples is also a component of the described process. The recirculation device specified must be capable of maintaining a temperature within the specification of the MW maximum wattage used. The recirculation device should be one with push-pull recirculation capabilities for both heating and cooling of the reagent, as required.

The present invention can increase productivity in all settings described and is anticipated to produce excellent processing results when ethylenediamine tetraacetic acid (EDTA) and 10% neutral buffered formalin are combined. EDTA is known to preserve tissue ultrastructure when the decalcification process is accelerated in the MW.

Further aspects of the present invention speak directly to the problems associated with other MW methods. The invention provides for the control of all processing variables associated with previously published MW decalcification methods. The present invention establishes a MW effect as a processing variable in simultaneous decalcification and fixation procedures. The fixation process will be complete prior to decalcification.

The individual steps in the methodology of the present invention are described below in FIGS. 2A, 2B.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF DRAWINGS

Figure 1:
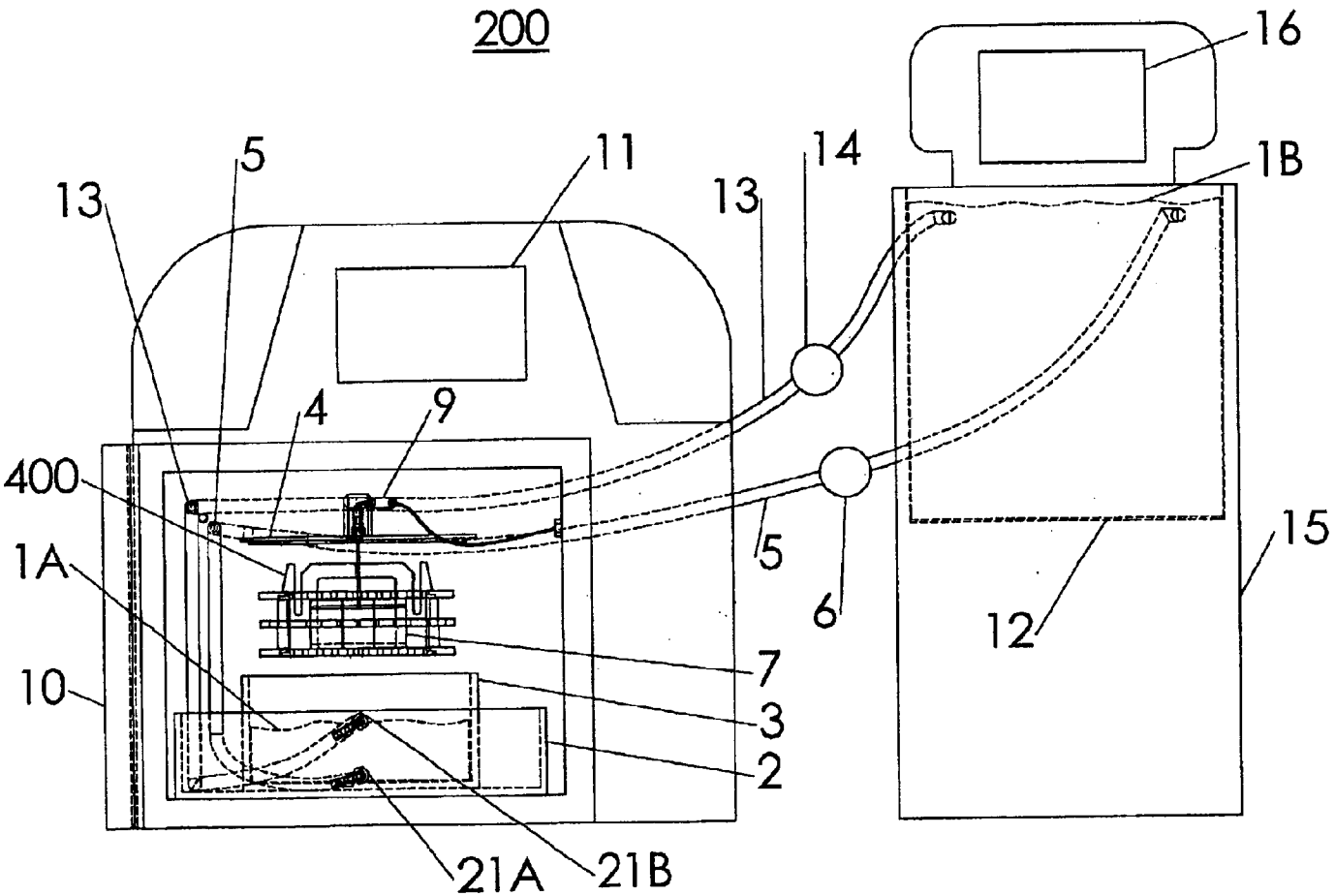
FIG. 1 is a frontal view of the decalcification and fixation apparatus of the present invention.

FIG. 1 is a frontal view of the decalcification and fixation system apparatus 200 of the present invention. Recirculation device 15 is capable of heating or cooling reagent 1A, 1B via a primary built-in temperature-monitoring device. Inlet tubing 5 and outlet tubing 13 are connected to recirculation device 15 to move decalcification and fixation reagent 1A, 1B for cooling or heating. The portion of reagent 1B in recirculation device 15 is heated or cooled as it is pumped into tissue processing bath 3 where a portion of reagent 1A resides within the recirculation loop. Recirculation device 15 has a duplex pump and can act as a push/pull device as the reagent is heated or cooled. Recirculation device 15 should be specified to be capable of maintaining reagent temperatures to within +/−0.5° C. at 20° when 500 w is being dissipated by MW oven 10. Recirculation device control panel 16 has basic control keys, such as power on/off, temperature setting, temperature display, etc. Recirculation device 15 contains an internal reagent bath 12 and the primary reagent temperature is controlled by recirculation device 15 within its internal reagent bath 12 by the combination of heating and cooling as required. Anti siphon devices 6, 14 help insure that proper reagent levels are maintained within tissue processing bath 3. Tubing 5, 13 is connected through an entry point in the rear of MW oven 10 and enters tissue processing bath 3 to form a closed loop system for recirculation. Tubing 5, 13 are inserted over inlet fitting 21A and outlet fitting 21B within tissue processing bath 3. Tissue processing bath 3 is an open container, which fits into overfill safety container 2. Overfill safety container 2 insures any excess reagent is contained without spillage. Tissue samples are prepared and placed into standard histology cassettes 7, which are in turn placed into cassette holder 400. Cassette holder 400 is then placed inside tissue processing bath 3 and thus into and submersed under the decalcification and fixation reagent 1.

Tissue processing tub lid 4 fits snuggly over tissue processing bath 3. Tissue processing lid has one hole in its top, which receives temperature probe 9 that sits within tissue processing bath 3 and acts as a secondary temperature control (in case of a failure in the temperature control portion of recirculation device 15) for temperature monitoring and recording of the processing reagent 1 temperature. Output from temperature probe 9 can also be monitored by a computer via a RS232 port for temperature data collection. Settings on the MW oven control panel 11 are inputted by the user prior to starting the decalcification and fixation process. Control keys such as power on/off, power settings, start, and reset are inputted.

Figure 1A:
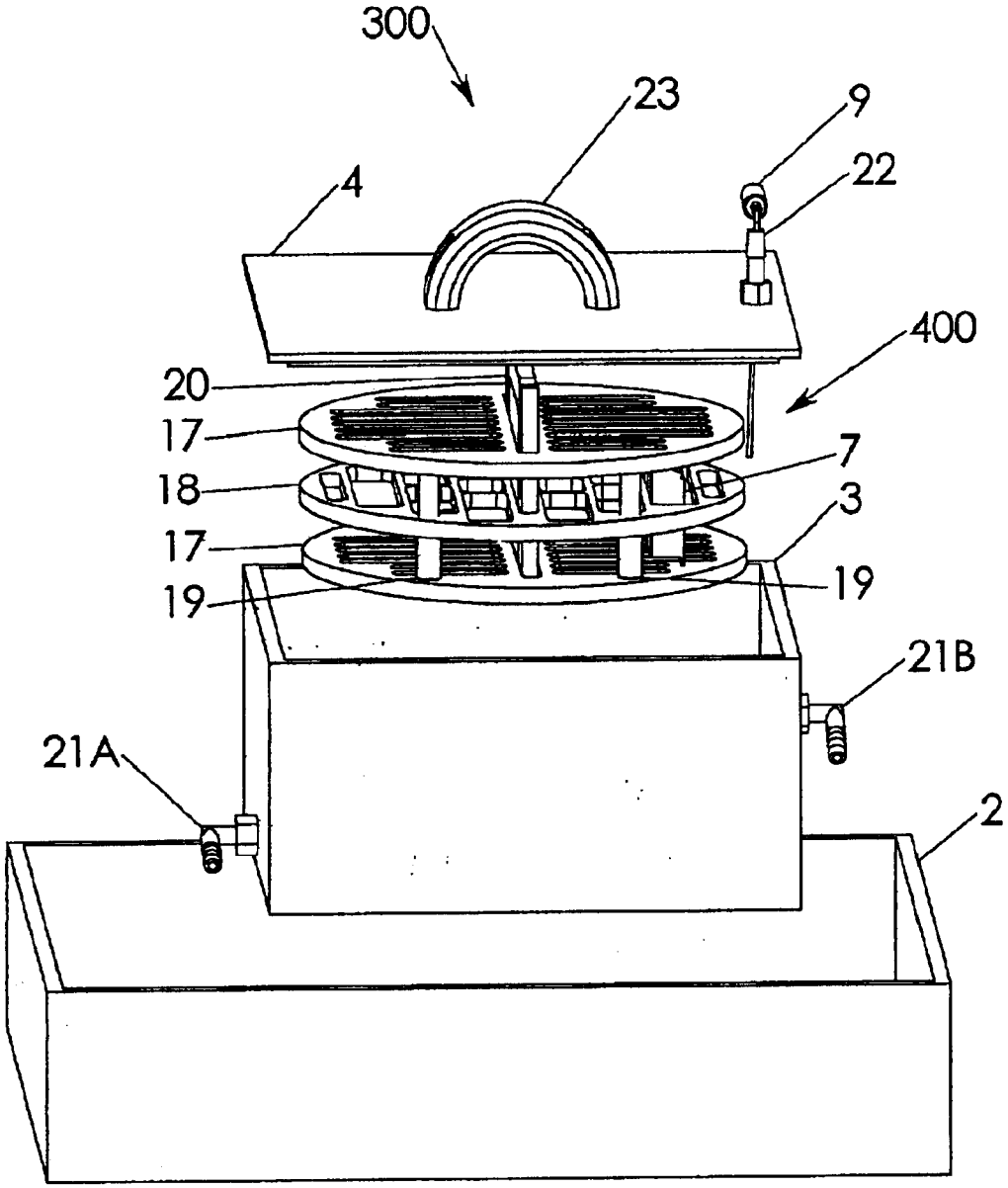
FIG. 1A is an expanded frontal perspective view of the overfill safety container, tissue processing bath and cassette holder.

FIG. 1A is an expanded frontal perspective view 300 of components within the MW oven consisting of overfill safety container 2, tissue processing bath 3 and cassette holder assembly 400. Tissue processing bath 3 fits into overfill safety container 2 and has inlet-fitting 21A attached to its lower side and outlet-fitting 21B attached to its upper side. Outlet-filling 21B maintains the proper reagent level within tissue processing bath 3. Cassette holder assembly 400 is made up of cassette holder top and bottom tray 17, which are identical in manufacture, cassette holder center tray 18, cassette holder posts 19 and cassette holder handle 20. Standard histology cassette(s) 7 are held in place within cassette holder assembly 400 during the decalcification/fixation processing. Tissue processing tub lid 4 has tissue processing container lid handle 23 affixed to its top and straight thru fitting 22 to accommodate temperature probe 9 which sits within tissue processing bath 3.

Figure 1B:
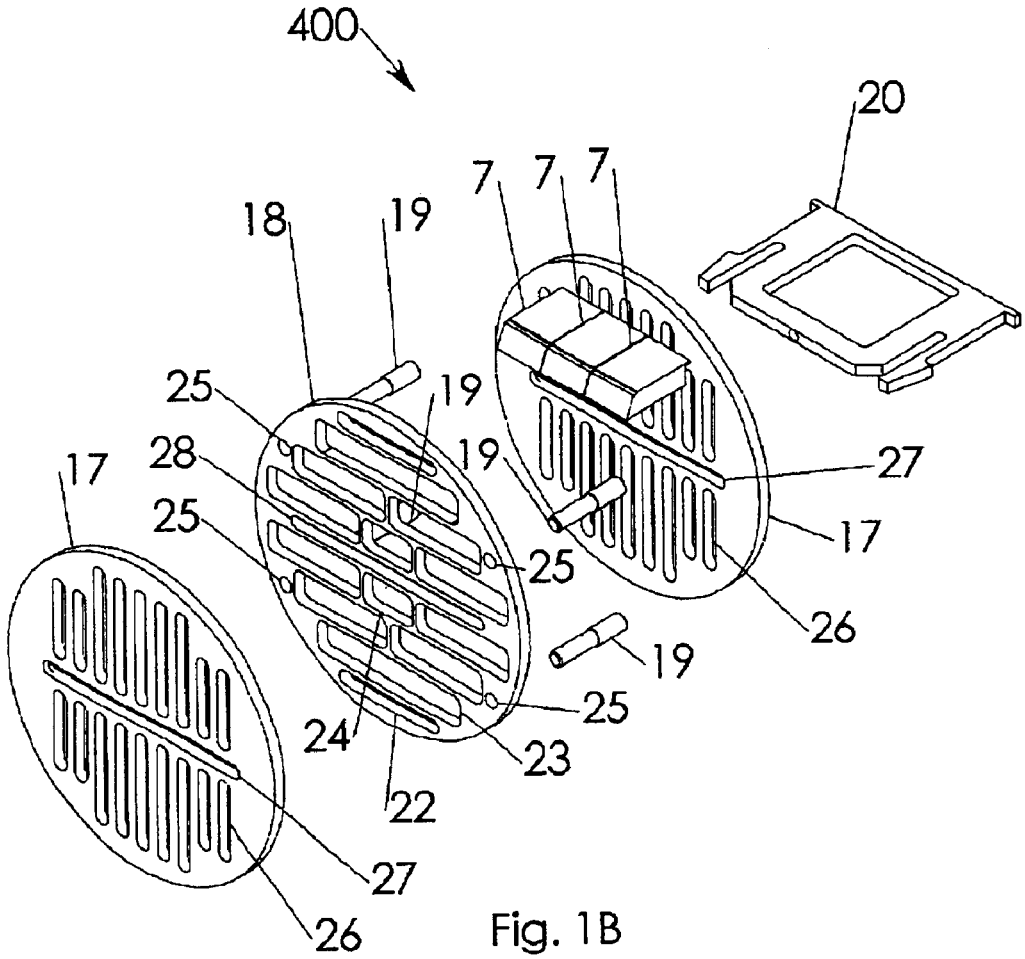
FIG. 1B is an expanded breakaway perspective view of the cassette holder shown in FIG. 1A above.

FIG. 1B is a further expanded breakaway perspective view of cassette holder assembly 400 showing top tray and bottom tray 17, which are identical in manufacture, cassette holder center tray 18, cassette holder posts 19 and cassette holder handle 20. Standard histology cassette(s) 7 are shown held in place within cassette holder assembly 400. Cassette holder handle 20 fits through the entire cassette holder assembly 400 and begins assembly at the bottom of cassette holder assembly 400. Cassette holder handle 20 fits through bottom tray slot 27, then through center tray slot 28, and finally through top tray slot 27 at which point it would snap into place with the top of cassette holder handle 20 protruding for handling and acts to hold the entire cassette holder assembly 400 in place. Center tray 18 has various size retention holes. A three-wide hole 23, a two-wide hole 22, and a one-wide hole 24 can accommodate various histology cassette 7 widths in some cases (only one width shown) or multiple histology cassettes. For example a three-wide hole 23 can accommodate six single-wide histology cassettes (not shown) or three double-wide histology cassettes as shown. Histology cassette(s) 7 can be designed in single- or double-wide widths as needed to accommodate different tissue sample sizes. Center tray 18 has four holder post acceptance holes 25 for inserting holder posts 19. Holder posts 19 function as a height standoff to separate bottom tray 17, center tray 18, and top tray 17. Top and bottom tray 17 have slotted holes 26 of various lengths to accommodate reagent pass through during processing. It should be noted that although only one cassette holder assembly design is shown, other designs are inferred to include accommodation of various other size cassettes such as a thicker cassette holder design which would need a thicker (wider) acceptance hole.

Figure 1C:
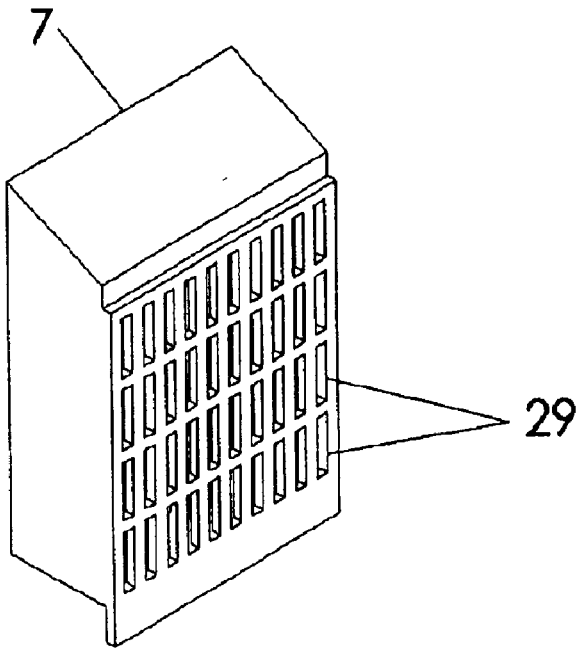
FIG. 1C is a frontal perspective view of standard histology cassette.

FIG. 1C is a frontal perspective view of standard histology cassette 7. Standard histology cassette(s) 7 are placed within cassette holder assembly 400 (see FIG. 1B). Each histology cassette 7 contains a multiple of reagent pass through holes 29 to insure proper circulation of reagent around the tissue specimen (see FIG. 1D) during processing.

Figure 1D:
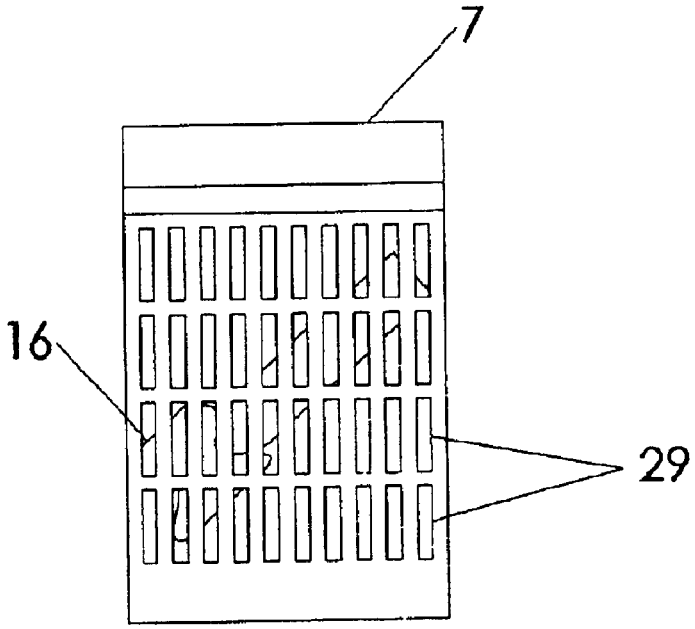
FIG. 1D is a frontal view of standard histology cassette showing an internal tissue sample.

FIG. 1D is a frontal view of standard histology cassette 7 with reagent pass through holes 29 showing internal tissue sample 16, which is held in place by cassette 7 during the decalcification/fixation process.

Figure 2A:
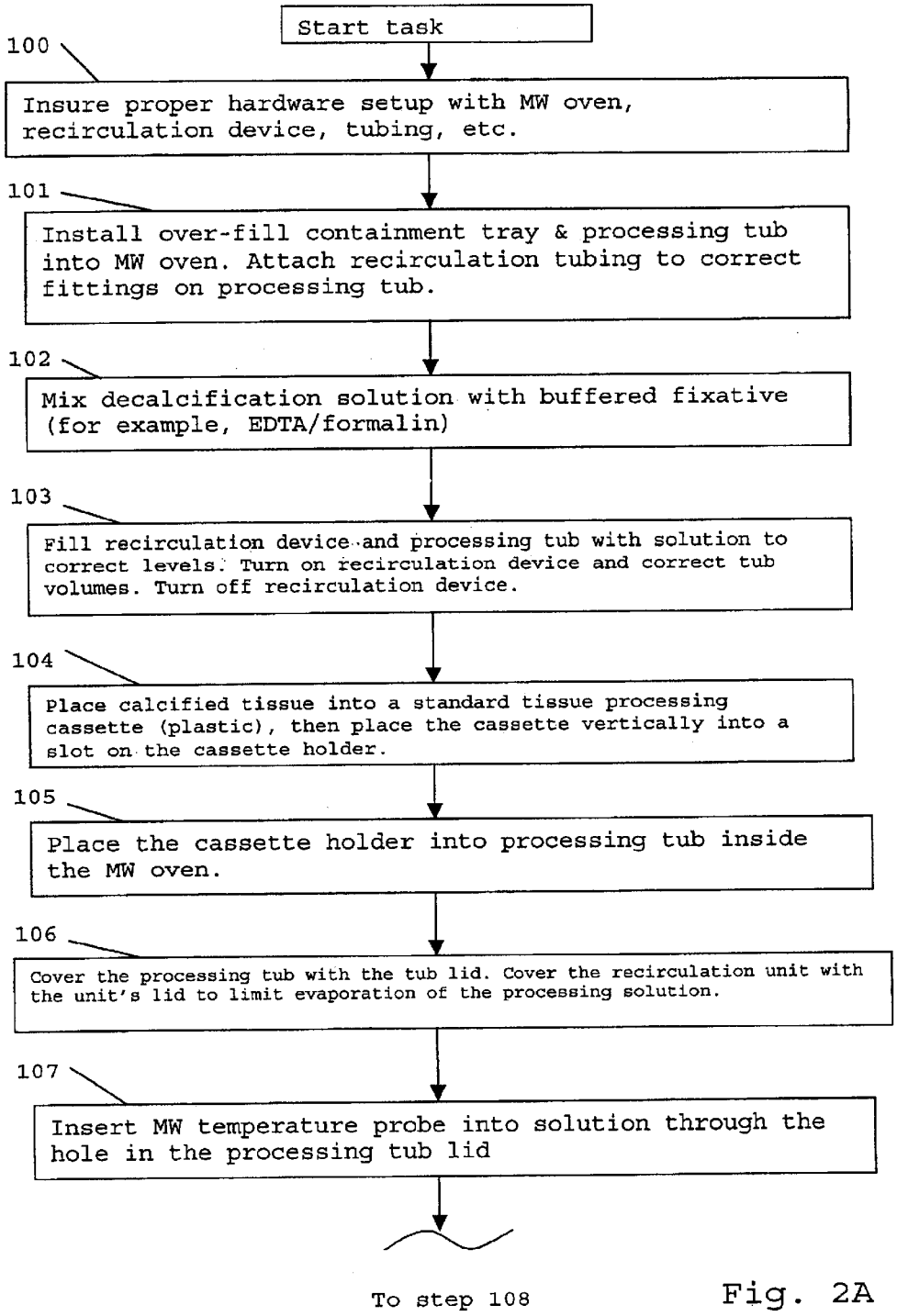
FIGS. 2A, 2B are a flow chart depicting the process steps utilized in the methodology of the present invention.
Figure 2B:
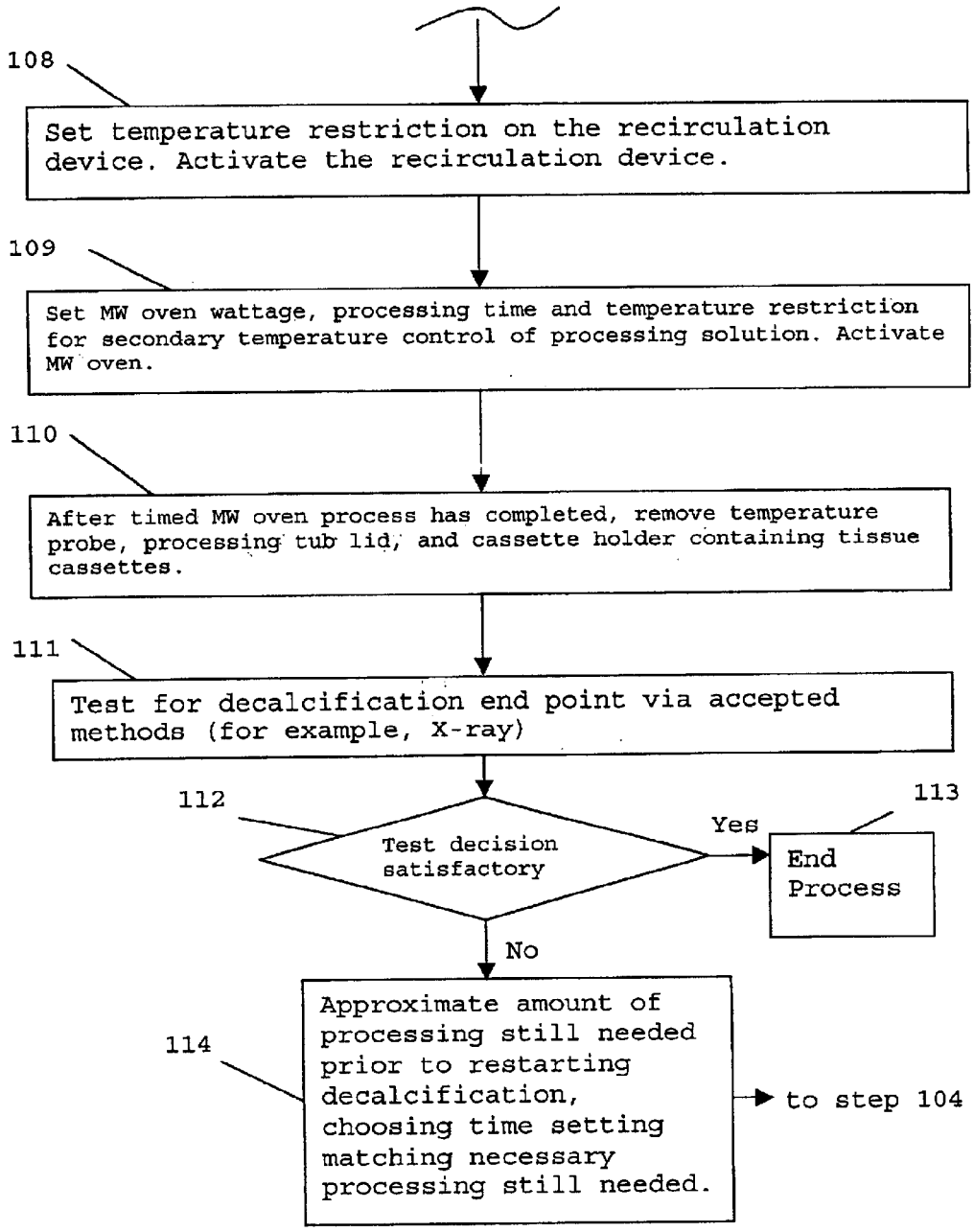

FIGS. 2A, 2B are a flow chart depicting the process steps utilized in the methodology of the present invention. To start the process (FIG. 2A), the first step 100 is to insure proper hardware setup is in place including the MW oven, the recirculation device, tubing attachments, etc. as shown in FIG. 1 above. In step 101, the hardware install is continued with the install of the over-fill containment safety tray and processing tub into the MW oven, and attachment of the recirculation tubing to the correct fittings on the processing tub. The next step 102 is the mix of the decalcification reagent and the buffered fixative such as EDTA and formalin as previously discussed. Next 103 the user will fill the recirculation device and processing tub with reagent to the correct levels, turn on the recirculation device and correct the tub volumes, then the user would turn off the recirculation device. The process then follows with step 104 in which the calcified tissue is placed into a standard tissue processing cassette (plastic material) and then the cassette is placed into the slot of the cassette holder in a vertical position. In the next step 105, the cassette holder is placed into the processing tub inside the MW oven. Step 106 consists of covering the processing tub with the tub lid, covering the recirculation unit with the unit's lid. The lids act to limit any evaporation of the processing reagent. The temperature probe is then inserted into the reagent through the hole in the processing tub lid, step 107. Continuing on to FIG. 2B, the next step 108 is to set the temperature restriction on the recirculation device and then to active the recirculation device. Then, in step 109, the MW oven wattage, processing time and temperature restriction for the secondary temperature control of the processing reagent is set, followed by activating the MW oven. After the timed MW oven process is complete, step 110, the user removes the temperature probe from the lid of the processing tub, removes the processing tub lid itself, and then removes the cassette holder from the processing tray. The cassette holder contains the tissue cassettes. The user then tests for decalcification end point, step 111, using accepted methods such as X-ray. If the test decision 112 is satisfactory, the process is ended 113. If the test decision 112 is not satisfactory, the user approximates the amount of processing still needed prior to restarting decalcification, choosing time setting matching necessary processing, step 114. The process then proceeds back to step 104 for additional processing. It should be noted that there are two distinct processes occurring during the above decalcification and fixation. The fixation process will be complete prior to decalcification.

Figure 3:
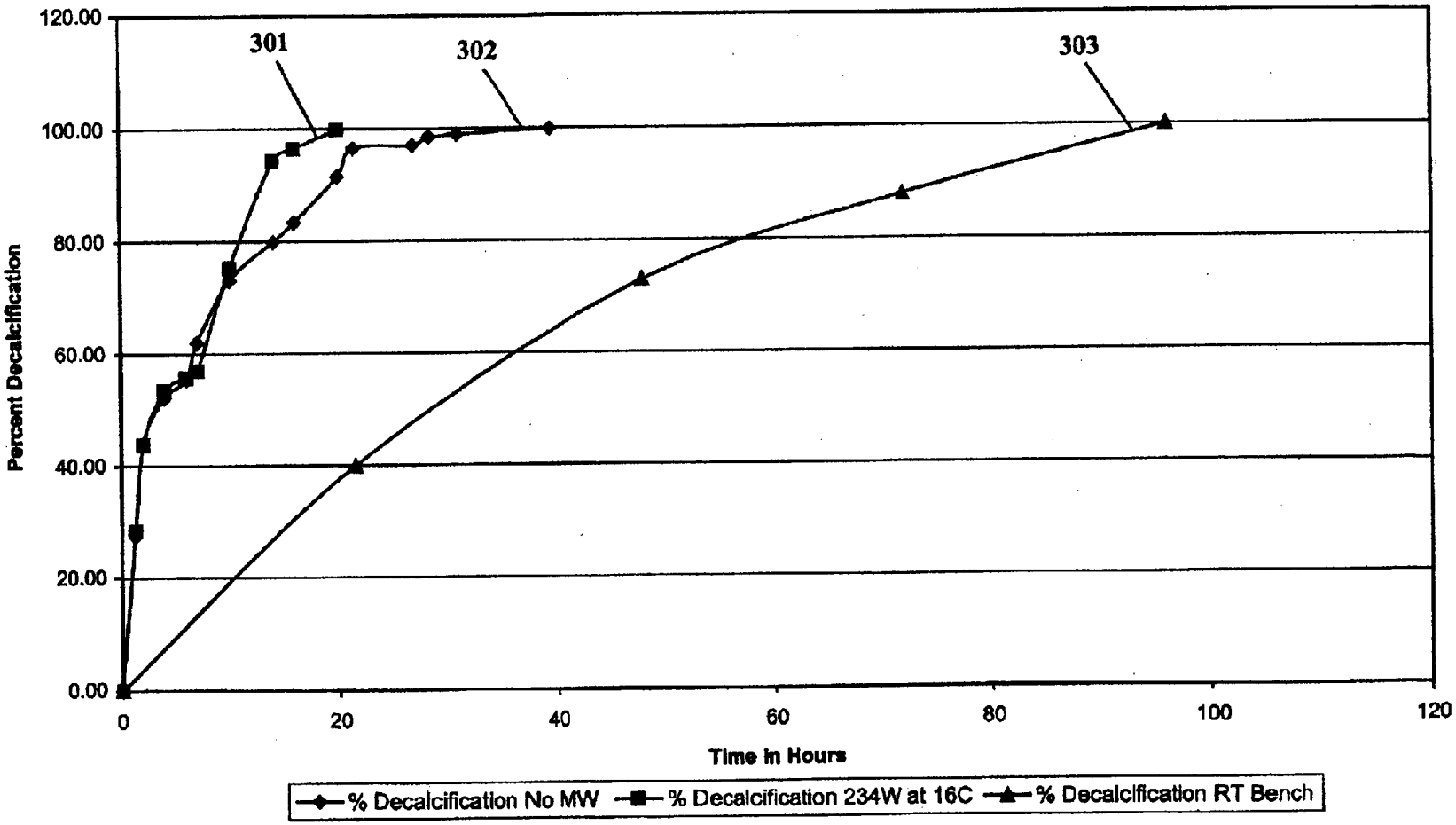
FIG. 3 is a graph showing the percentage of decalcification over time with three different processing methods.

FIG. 3 is a graph showing the percentage of decalcification over time with three different processing methods. A test was run to determine if the rate of MW assisted decalcification could be influenced by recirculation of the decalcification reagent around tissue samples. A phosphate buffered (pH 6.8–7.4) 10% ethylene diamine tetraacedic acid (EDTA) reagent was used for decalcification. Prior art for MW assisted decalcification has established that EDTA, of all decalcifying reagents, yields the best processing results for tissue structure and immunolabeling after decalcification is completed. The procedures used were as follows:

1) Standard Room Temperature (RT) Processing: Calcified tissues were placed in vials with constant rotation (16 rpm at 30° inclination). 10 ml vials filled with 5 ml of decalcification reagent were kept at room temperature (20° C.) with daily 5 ml changes of reagent until decalcification was complete.
2) Processing with the recirculation of decalcification reagent only: Calcified tissue samples were placed in standard histology cassettes which were placed in the apparatus described in FIG. 1 above. Decalcification reagent was recirculated around the samples at 20° C. until decalcification was complete.
3) Processing with the recirculation of decalcification reagent at constant temperature (20° C.) and continuous MW irradiation at 234 w. Samples were treated identically to the process described in "2" above except for the addition of continuous MW irradiation at 234 w.

Random samples were removed from each processing group at various time intervals, dehydrated and embedded in epon/araldite resin. One-micron sections were cut and evaluated by light microscopy to determine the extent of decalcification (a percent estimate). Determinations were made by the amount of unstained tissue (still calcified bone) present in the sample at each time interval.

The three curves shown in FIG. 3 are the results of:

1) standard RT processing 303;

2) processing with the recirculation of decalcification reagent only 302; and 3) processing with the recirculation of decalcification reagent at constant temperature (20° C.) and continuous MW irradiation at 234 w 301.

It can be seen from the graph of FIG. 3 that tissue processed by standard RT processing 303 required a total of 96 hours for decalcification. Recirculation of decalcification reagent only 302 around the tissue samples (no MW) reduced the time to 39 hours. With the addition of continuous MW irradiation 301, the time was further reduced to 18 hours. Prior art has not described a reagent (reagent) recirculation around samples or continuous MW irradiation; whereas the present invention describes, and the above test demonstrates, that reagent recirculation combined with continuous MW irradiation provides a significant improvement in processing time. As previously described, the method of the present invention be standardized and does not need technician intervention. Prior art describes results employing higher reagent temperatures and MW oven wattages. The optimization of the methodology of the present invention with respect to reagent temperature and MW power output has a positive potential to accelerate the decalcification process even further.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A method to decalcify a tissue specimen, said method comprising the steps of:

suspending a fixated tissue specimen in a circulating fluid stream of a decalcification reagent; and placing the specimen in a microwave oven;

irradiating the specimen with microwave radiation;

supplying a reservoir for the fluid stream external to the microwave oven;

controlling the temperature of the reservoir with a heating and cooling apparatus associated with the reservoir;

operating the microwave oven in the range of about 450 watts or less power; and selecting the decalcification reagents from the group consisting of: EDTA, formic acid-based reagents, nitric acid-based reagents, hydrochloric acid-based reagents, sulphuric acid-based reagents, acetic acid-based reagents, Decal®, Decal Stat®, Formical-2000®, and Immunocal®.

2. The method of claim 1 further comprising the step of:

controlling the fluid adjacent to the specimen inside the microwave oven with a backup temperature control loop that uses the microwave oven to maintain a setpoint temperature in the event of a failure of the reservoir heating and cooling apparatus.

3. The method of claim 1 further comprising the step of controlling the fluid temperature in the range of about 4° C. to 45° C.

4. The method of claim 1 further comprising the step of controlling a fluid depth around the tissue specimen to fully immerse the tissue specimen.

5. The method of claim 1 further comprising the step of regulating a preset time of operation for the microwave irradiation.

* * * * *